United States Patent [19]

Conrad et al.

[11] 4,179,150

[45] Dec. 18, 1979

[54] SAFETY ARMING DEVICE FOR MISSILES

[75] Inventors: Coleman W. Conrad, Whittier; Edward W. Fenska, Altadena, both of Calif.

[73] Assignee: IMC Magnetics Corporation, Los Angeles, Calif.

[21] Appl. No.: 846,712

[22] Filed: Oct. 31, 1977

[51] Int. Cl.[2] ..... B66C 1/38

[52] U.S. Cl. ..... 294/83 R; 89/1.5 D

[58] Field of Search ..... 294/83 R, 83 A, 83 AA; 89/1.5 D, 1.5 R, 1.5 E; 24/230

[56] References Cited

U.S. PATENT DOCUMENTS 2,992,594 7/1961 Anderson et al. ..... 89/1.5 D

*Primary Examiner*—James B. Marbert

*Attorney, Agent, or Firm*—Albert M. Herzig; Edward C. Walsh

[57] ABSTRACT

Safety arming solenoid for use with missiles. Pivoted jaw means retain the end of an arming wire or cable that connects to the missile. A solenoid controls opening of the jaw means. The solenoid is a rotary type having a stem with an end part positionable angularly to restrain the jaws against opening or to release them. In a modified form, a second coil is provided whereby the solenoid armature has linear as well as angular motion for actuating the jaws in response to linear movement.

15 Claims, 5 Drawing Figures

SAFETY ARMING DEVICE FOR MISSILES

BACKGROUND OF THE INVENTION

1. Field of the Invention

The field of the invention is that of solenoid actuated safety arming devices particularly adapted for use in connection with controlling the arming of missiles at the time of release from an aircraft.

2. Description of the Prior Art

Safety arming devices for use in connection with missiles that are dropped from aircraft are known in the art. This type of device actuated by a solenoid is known. An arming wire or cable connects from the aircraft to the missile when the missile is dropped. If the cable is restrained at the aircraft end the pull on the calbe arms the missile. If it is not restrained or held at the aircraft end, but rather released, the cable leaves with the missile which is not armed. A form of the device as described is shown in U.S. Pat. No. 2,845,003. In this patent, a solenoid plunger cooperates with a ring at the end of a cable to restrain it.

Other types of safety arming devices are known wherein the end of the cable is restrained by the solenoid control jaw means, there being a pair of jaws or only a single jaw. Prior art patents of this type include U.S. Pat. Nos. 2,430,617; 2,720,835; 2,941,442; 2,987,655; 2,992,594; 3,285,132, British Pat. No. 328,662 and British Pat. No. 563,003.

U.S. Pat. No. 3,200,707 is exemplary of the first type of safety arming device. The prior art devices are subject to certain lack of capability or deficiency. Aircraft carrying the missiles and the solenoid actuated arming device, of course, are subject to particular conditions involved in maneuvering and fluttering of the wings such that at times it is possible that there are G forces of 300 or more which can actuate the solenoid plunger even when it is not electrically actuated. This circumstance would prevent the dropping of a missile in the unarmed condition if the pilot wanted it to be unarmed. Thus, the missile would be armed when it was not the pilot's intention to be armed. This particular deficiency is one that is overcome by the invention as described in detail herein.

SUMMARY OF THE INVENTION

As previously identified, the invention is an arming device and particularly adapted for arming of missiles when dropped from an aircraft. In the exemplary forms of the invention as described in detail herein, it is a solenoid actuated device which activates jaw means that control the arming of the missile. It is to be understood, of course, that the arming device of the invention might be used in other ways including the arming or other control of different ordnance stores or otherwise. Explosive ordnance items are known in military circles as ordnance "stores".

In the exemplary forms of the device described in detail herein, the arming device controls release of an arming wire that connects between the aircraft and a missile. The solenoid actuated arming device controls jaw means that hold a ring at the end of the arming wire. If the arming wire is not released when the missile is dropped, the pull on the wire arms the missile. If the missile is not to be armed, the arming device releases the wire and it is dropped with the missile without arming it.

In the exemplary forms of the device, pivoted jaw means hold a ring at the end of the arming wire. The arming solenoid is rotary and actuates a stem having an end part positionable angularly to restrain the jaw means against opening. Dependence is not had on linear movement of the stem.

The foregoing identifies the capability of the device preventing opening of the jaw means. It may be desired to have available the capability of controllably or forcibly opening the jaw means. In a modified exemplary form of the device, this capability is provided. Solenoid means are provided having the combined capability of rotary or angular movement and also linear movement. The mechanism includes a linearly movable stem preferably having a ball on the end which can cooperate with the jaw means to forcibly open the jaws to release the ring at the end of the arming wire.

In the light of the foregoing, the primary object of the invention is to provide an improved solenoid actuated mechanism for performing a control function which is particularly adapted for the arming of ordnance items such as missiles.

A further object is to realize a device as in the foregoing object wherein actuation of the arming mechanism is by way of rotary solenoid means which imparts angular movement to a stem which in one position prevents actuating movement to arm a missile.

A further object is to realize a mechanism as in the foregoing wherein the angularly movable stem cooperates with pivoted jaw means that hold the end of an arming wire.

Further objects and additional advantages of the invention will become apparent from the following detailed description and annexed drawings.

DESCRIPTION OF THE PREFERRED EMBODIMENTS

Figure 1:
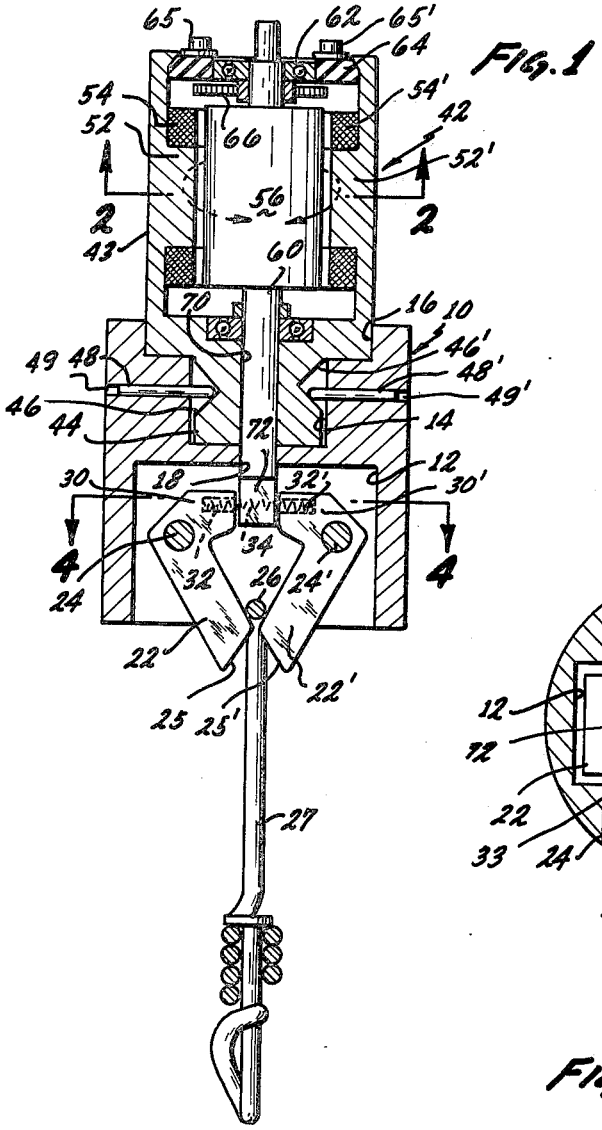
FIG. 1 is a sectional view of a preferred exemplary form of the invention.

Referring to FIGS. 1–4 of the drawings, numeral 10 designates the body of one form of the arming device. This body may be made of steel or other suitable material. In its lower part, it has a recess 12. In its upper part is a bore 14 and a counterbore 16. Between the bore and recess 12 is a smaller axial bore 18.

Pivotally mounted in the body 10 in the recess 12 is a pair of holding jaws including jaws designated by the numerals 22 and 22', these jaws being alike. The jaws are of bell-crank shape, being mounted on pivot members 24 and 24' journalled in transverse bores within the recess 12. The lower ends of the jaws are bevelled as shown at 25 and 25', and in the position as shown in FIG. 1, they hold a ring member 26 which is at the end of an arming wire 27, the lower end of which as described in the foregoing, can be connected to a missile for purposes of arming the missile when there is a strong pull on the arming wire.

Figure 4:
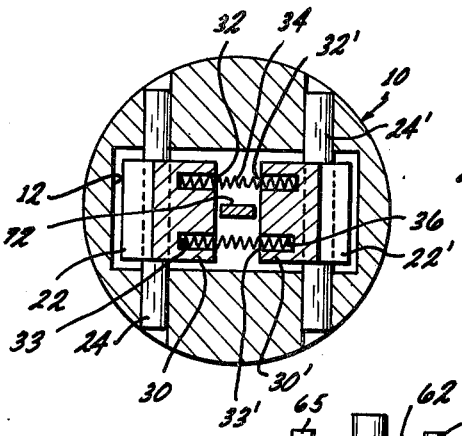
FIG. 4 is a sectional view taken along the line 4—4 of FIG. 1.

The upper ends of the jaws 22 and 22' extend inwardly, these ends being designated at 30 and 30'. In the end 30 of the jaw 22 are bores 32 and 33 and in the end 30' of the jaw 24' are bores 32' and 33', and disposed in the four bores in a position as may be seen in FIG. 4, are biasing springs 34 and 36 which normally urge these ends of the jaws apart so that the jaws are urged into a closing position as shown in FIG. 1.

Positioned above the body 10 is the solenoid mechanism designated by the numeral 42. It includes a cylindrical housing 43 having a lower part 44 of smaller diameter that fits into the bore 14 in the body 10, the part of the body 43 of larger diameter fitting into the counterbore 16 as shown. Formed in the lower part 44 is an annular groove of triangular cross-section as designated by the numeral 46. Two or more radial pins are provided designated by the numerals 48 and 48' which are received in radial bores 49 and 49'. The ends of these pins fit against an angular surface formed by one side of the annular groove 46 and the pressure against the part 44 holds the solenoid 42 and the body 10 together and prevents tilting or misalignment which result from the relatively strong pulls that may be exerted on the arming wire 27.

Figure 2:
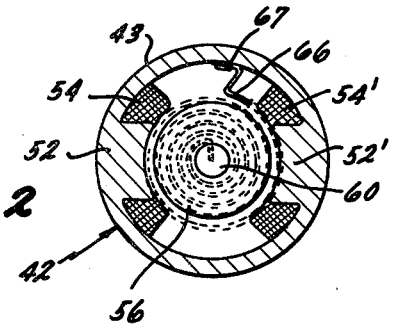
FIG. 2 is a cross-sectional view taken along the line 2—2 of FIG. 1.

The solenoid is a rotary solenoid having a stator and an armature or rotor. Formed on the inside of the body 43 are stator core members 52 and 52' around which are windings as designated at 54 and 54'. The rotor itself is designated at 56. It may be either of a permanent magnet type or a reluctance type. The rotary solenoid itself may be of conventional construction. The rotor has north and south poles as shown in FIG. 2.

The rotor is mounted on a rotor shaft 60. The upper end of the rotor shaft is mounted in a ball bearing 62 carried in an end member 64 which is in the end of the body 43 and which carries electrical terminals 65 and 65'. Attached to the shaft 60 is a spiral biasing spring 66. As will be described, normally, the shaft can rotate through 90° and can then be returned by the return spring. Numeral 67 is a bracket on the inside of the body 43 positioned to limit angular movement of the rotor shaft.

The rotor shaft 60 extends through axial bore 70 in the lower part of the body 43 and through the bore 18 in the body 10. At the end of the shaft is an extending narrow finger as designated at 72 in FIG. 3 which is positioned between the ends 30 and 30' of the jaws 22 and 22'.

Figure 3:
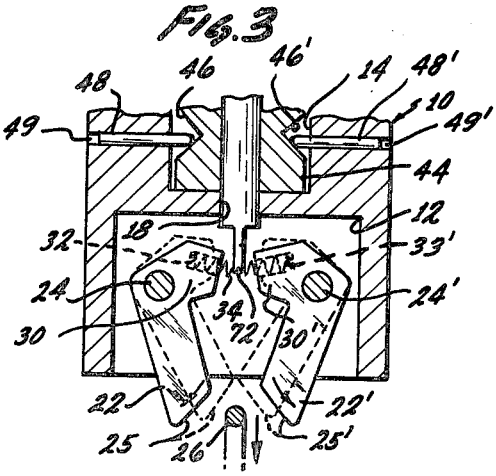
FIG. 3 is a partial sectional view of the form of the invention shown in FIGS. 1 and 2 with the jaw means in another position.

Referring to the operation of the arming device, FIG. 1 shows an inactive position of the device wherein the jaws 22–22' are held in the closed position holding the ring 26 in this position. Upon dropping of the missile, the strong pull on the wire 27 would cause arming of the missile. The finger 72 is in a position as shown to hold the ends 30 and 30' apart. Upon energization of the rotarty solenoid, the rotor and its shaft would rotate through 90° turning the shaft so that the finger 72 is positioned as shown in FIG. 3. In this position, the upper ends 30 and 30' of the jaws are able to move together against the springs 34 and 36. Thus in this position, if the missile is dropped, there is strong enough pull on the wire 27 to pull the ring 26 from the jaws, the jaws being allowed to open sufficiently for that purpose. In this event, the wire 27 would stay with the missile which would be dropped in an unarmed condition.

Figure 5:
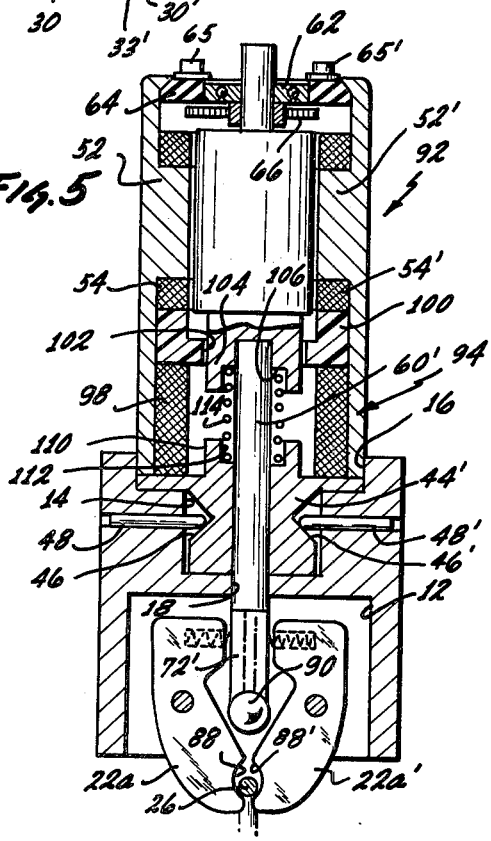
FIG. 5 is a sectional view showing a modified form of the invention.

FIG. 5 shows a modified form of the arming solenoid constructed to have both the capability of angular movement and linear movement of the actuating stem. Parts that are the same as corresponding parts in the previous embodiment are identified by the same reference numerals; the corresponding parts that are slightly different are identified by reference numerals primed. In FIG. 5, the pivoted jaws are identified by the numerals *22a* and *22a'*. They have a slightly different shape as indicated in FIG. 5 and are similarly biased by springs as in the previous embodiment. The lower ends of the jaws have arcuate recesses as designated at 88 and 88' which cooperate with the ring 26.

At the lower end of the shaft or stem 60' is a narrow finger 72' similar to that of the previous embodiment and at the lower end of the finger is a ball 90 which is in a position such that upon downward movement of the stem 60', the ball can engage inside surfaces of the jaws *22a* and *22a'* and cause the jaws to move about the pivots in opening or releasing direction as respects the ring 26. That is, the jaws can be forcibly actuated to release.

The solenoid mechanism is designated by the numeral 92, the solenoid embodying the rotary as well as the linear capability. The rotary solenoid is like that of the previous embodiment.

Positioned below the rotary solenoid is a linear solenoid designated by the numeral 94, the linear solenoid having a stator core part 96 formed on the inside of the housing 43' with an associated circular winding 98.

Positioned inbetween the windings 54–54' and the winding 98 of the linear solenoid is a spacer ring 100, the lower part of which has a bore 102. Carried at the lower end of the rotor 56 is the linear solenoid or armature 104 from which the shaft or stem 60' extends downwardly. Formed in the lower end of this armature core is a conterbore 106. The member 44' that fits in the counterbore 14 of the body 10 has an upstanding part 110 in which is formed a counterbore 112, there being a biasing spring 114 having its ends positioned in the counterbores 106 and 112 so that it normally urges the rotor 56 and solenoid core 104 and stem 60' upwardly. When the linear solenoid is energized, stem 60' is pulled downwardly so that the ball 90 engages the inside surfaces of the jaws *22a* and *22a'* causing them to separate and to release the ring 26.

From the foregoing, the operation of the form of the invention shown in FIG. 5 will be readily understood. As respects the rotary solenoid, operation is like that of the previous embodiment. The additional capability is provided of forcibly causing the jaws to release upon command. As described, this occurs when the linear solenoid is energized causing the stem 60' to move downwardly.

From the foregoing, those skilled in the art will readily understand the nature and characteristics of the invention and the manner in which it realizes all of the objects and advantages as set forth in the foregoing. The foregoing disclosure is representative of preferred forms of the invention and is to be interpreted in an illustrative rather than a limiting sense, the invention to be accorded the full scope of the claims appended hereto.

What is claimed is:

1. In an electrically actuated control device, in combination, holding means including at least one pivotally movable holding member, a second member with which the said one member cooperates, said first and second members having portions constructed for relative movement for purposes of releasing, the improvement comprising means to control relative movement of said portions, said last means including an element having an axis mounted to be movable angularly about its axis, the said element having a configuration such that in one position said portions are permitted to move for releasing and in another position said portions are held from moving, and electrical means for actuating said element.

2. A device as in claim 1 wherein said element is in the form of an angularly movable stem, the electrical actuating means being in the form of a rotary solenoid.

3. A device as in claim 1 including jaw means, the jaw means including at least one jaw member formed by said pivoted member, and biasing means whereby said jaw member is normally urged in a holding direction.

4. A device as in claim 2 wherein said stem has an end part having width and thickness, the width being substantially greater than the thickness, the stem being angularly movable so as to position either its width or its thickness dimension between said portions.

5. A device as in claim 3 wherein said second member is in the form of a pivoted jaw member, said biasing means being positioned to act between the jaw members.

6. A device as in claim 1 wherein said means to control includes mechanism whereby to impart linear movement to said element, and means whereby the linear movement moves said first and second members relatively.

7. A device as in claim 6, the said element having an end part movable for actuating said jaw members.

8. A device as in claim 7 wherein said element is positioned between said jaw members and is constructed to move the jaw members apart when the element is moved axially.

9. A device as in claim 8 wherein said means to control includes a rotary solenoid for imparting axial movement to the stem and a solenoid for imparting linear movement to the stem.

10. In an electrically actuated control device, in combination, holding means including at least one pivotally movable holding member, a second member which the said one member cooperates, said first and second members having portions constructed for relative movement for purposes of releasing, the improvement comprising means to control relative movement of said portions, the last means including an element mounted to be movable, said element having a part positioned to engage said movable holding member and to move it in releasing direction, said element part being positioned between said portions of said members and being movable to exert a thrust against said one member.

11. A device as in claim 10 wherein said element is in the form of an axially movable stem, the electrical actuating means being in the form of a solenoid.

12. A device as in claim 11 including jaw means, the jaw means including at least one jaw member formed by said pivoted member, and biasing means whereby said jaw member is normally urged in a holding direction.

13. A device as in claim 12 wherein said second member is in the form of a second pivoted jaw member, the said stem having a position to engage both jaw members to move them apart.

14. A device as in claim 11 including means for moving the element angularly about its axis, the element having a part positioned between said portions having a construction whereby in one angular position of the element relative movement of the said members is prevented.

15. A device as in claim 14 wherein the said second member is also a pivoted jaw member.

* * * * *